US008495958B2

(12) United States Patent
Sugimoto et al.

(10) Patent No.: US 8,495,958 B2
(45) Date of Patent: Jul. 30, 2013

(54) PRINTER FOR CORRUGATED CARDBOARD SHEET AND BOX MAKING MACHINE FOR CORRUGATED CARDBOARD SHEET

(75) Inventors: Kazuya Sugimoto, Hiroshima-ken (JP); Yasunari Suzuki, Hiroshima-ken (JP); Osamu Hatano, Hiroshima-ken (JP); Mitsuhiro Nadachi, Hiroshima-ken (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 277 days.

(21) Appl. No.: 12/810,204

(22) PCT Filed: Dec. 18, 2008

(86) PCT No.: PCT/JP2008/073107

§ 371 (c)(1), (2), (4) Date: Jun. 23, 2010

(87) PCT Pub. No.: WO2009/087879

PCT Pub. Date: Jul. 16, 2009

(65) Prior Publication Data

US 2010/0288142 A1 Nov. 18, 2010

(30) Foreign Application Priority Data

Jan. 7, 2008 (JP) ..... 2008-000574

(51) Int. Cl.
*B41F 31/34* (2006.01)

(52) U.S. Cl.
USPC ..... 101/352.01; 101/351.1

(58) Field of Classification Search
USPC ..... 101/352.01, 351.1, 351.3, 351.4, 101/352.04, 352.05, 218, 247
See application file for complete search history.

(56) References Cited

U.S. PATENT DOCUMENTS

| | | | | |
|---|---|---|---|---|
| 4,322,963 | A * | 4/1982 | Fitzpatrick et al. | 72/387 |
| 4,650,535 | A * | 3/1987 | Bennett et al. | 156/352 |
| 5,421,258 | A | 6/1995 | Marozzi et al. | |
| 5,485,784 | A * | 1/1996 | Walschlaeger, Sr. | 101/415.1 |
| 6,062,751 | A * | 5/2000 | Baum | 400/621 |

FOREIGN PATENT DOCUMENTS

| | | |
|---|---|---|
| EP | 0490475 A1 | 6/1992 |
| JP | 63-051173 A | 3/1988 |
| JP | 3042183 | 6/1991 |

(Continued)

OTHER PUBLICATIONS

ISR for PCT/JP2008/073107 dated Feb. 3, 2009.
Extended European search report dated Feb. 18, 2011 corresponding to European patent application No. 08870435.8.
EPC Communication under Rule 71(3) for Application No. 08 870 435.8 mailed Jul. 30, 2012.

(Continued)

*Primary Examiner* — Matthew G Marini
*Assistant Examiner* — Leo T Hinze
(74) *Attorney, Agent, or Firm* — Lowe Hauptman Ham & Berner, LLP

(57) ABSTRACT

In a printer for corrugated cardboard sheets and a box making machine for corrugated cardboard sheets, a control device that controls an operation of an air cylinder is provided such that an ink supply roll is moved toward or away from a printing cylinder relative to an intermediate position of a gap between ends of a printing plate attached on a surface of a printing cylinder. With this configuration, ink of an ink supply roll is appropriately transferred to the printing plate, an ink film on the printing plate is uniformized, and then printing precision is enhanced.

12 Claims, 6 Drawing Sheets

FOREIGN PATENT DOCUMENTS

| | | | |
|---|---|---|---|
| JP | 4272859 | | 9/1992 |
| JP | 06-218908 | A | 8/1994 |
| JP | 2602428 | Y2 | 11/1999 |
| JP | 2005-014369 | A | 1/2005 |
| JP | 2009119636 | | 6/2009 |

OTHER PUBLICATIONS

Japanese Office Action for Application No. 2008-000574 mailed Oct. 23, 2012.

* cited by examiner

PRINTER FOR CORRUGATED CARDBOARD SHEET AND BOX MAKING MACHINE FOR CORRUGATED CARDBOARD SHEET

RELATED APPLICATIONS

The present application is national phase of International Application Number PCT/JP2008/073107, filed Dec. 18, 2008, and claims priority from, Japanese Application Number 2008-000574, filed Jan. 7, 2008, the disclosures of which are hereby incorporated by references herein in their entirety.

TECHNICAL FIELD

The present invention relates to a printer for corrugated cardboard sheets for performing printing on a surface of corrugated cardboard sheets, and also to a box making machine for corrugated cardboard sheets to which the printer for corrugated cardboard sheets is applied.

BACKGROUND ART

A general box making machine for corrugated cardboard sheets produces corrugated cardboard boxes by processing a corrugated cardboard sheet in which a corrugating medium is adhered between a pair of liners, and includes a sheet feeding unit, a printing device, a slotter/creaser, a folding unit, and a counter ejector.

According to the sheet feeding unit, a kicker that is operated by a crank lever kicks out corrugated cardboard sheets stacked on a table, feed rolls sandwich the corrugated cardboard sheets at a constant speed, and feed them to the printing device.

The printing device performs printing in a single color or multiple colors, and includes one or more printing units. Each of the printing units includes a printing cylinder, and a printing plate is mounted on the cylinder. An ink supply roll that is abutted against the printing plate is provided near the printing cylinder, and an ink chamber that stores printing ink is provided near the ink supply roll. Ink is supplied on a surface of the ink supply roll from the ink chamber, and the ink is transferred to the printing plate. A receiving roll is provided below the printing cylinder, and printing is performed in a state that the corrugated cardboard sheet is sandwiched between the printing plate and the receiving roll.

The slotter/creaser draws a creasing on a printed corrugated cardboard sheet by first and second creasing rolls, and cuts a slot in the creased corrugated cardboard sheet by a slotter knife.

A folding unit applies an adhesive to a sticking tab piece by an adhering device while moving the corrugated cardboard sheet. The corrugated cardboard sheet to which the adhesive is applied is continuously moved and in this state, a folding bar and a folding belt fold the sheet, and the sticking tab piece is adhered, thereby producing a corrugated cardboard box. The corrugated cardboard sheets are folded and adhered and the corrugated cardboard boxes are formed, and the counter ejector stacks these boxes by a hopper, sorts these boxes into batches with a predetermined number of boxes, and then discharges the batch of the predetermined number of the boxes.

According to the box making machine for corrugated cardboard sheets having such a configuration, in the printing device, ink is supplied on a surface of the ink supply roll from the ink chamber, and when the ink supply roll rotates, ink is transferred onto a surface of the printing plate of the printing cylinder that is opposed and in contact with the ink supply roll, the corrugated cardboard sheet is conveyed between the printing plate and the receiving roll, and then printing is performed on the surface of the corrugated cardboard sheet.

Patent Documents 1 and 2 mentioned below disclose such a printer for corrugated cardboard sheets.

Patent Document 1: Japanese Patent No. 2974100

Patent Document 2: Japanese Utility Model Registration No. 2602428

DISCLOSURE OF INVENTION

Problem to be Solved by the Invention

In the printing device, the ink supply roll receives supply of ink from the ink chamber, moves toward the printing cylinder at a predetermined timing and comes into contact with the printing plate, thereby transferring ink from the ink supply roll to the printing plate. In this case, when the ink supply roll does not move toward the printing cylinder at an appropriate timing with respect to the printing cylinder, it becomes difficult to uniformly transfer ink on the surface of the printing plate. That is, it is necessary that the ink supply roll is moved toward the ends of the printing plate and comes into contact with the rotating printing cylinder. When the ink supply roll is moved toward the printing cylinder; however, an operation of the driving device is varied, and it becomes difficult to move the ink supply roll with high precision. As a result, the thickness of an ink film transferred on the surface of the printing plate is varied, and there is a problem that the printed color of an image on a corrugated cardboard sheet temporarily becomes darker or fades when sheet feeding is started.

The present invention has been achieved to solve the above problems, and an object of the invention is to provide a printer for corrugated cardboard sheets and a box making machine for corrugated cardboard sheets for enhancing printing precision.

Means for Solving Problem

According to an aspect of the present invention, a printer for corrugated cardboard sheets includes: a printing cylinder that is drivably and rotatably supported such that the printing cylinder is opposed to a conveyed corrugated cardboard sheet; a printing plate attached on a surface of the printing cylinder; an ink supply roll that is drivably and rotatably supported and supplies ink to the printing plate; a roll moving unit that can move the ink supply roll toward or away from the printing cylinder; and a control unit that controls an operation of the roll moving unit such that the ink supply roll moves toward or away from the printing cylinder relative to an intermediate position of a gap between ends of the printing plate.

Advantageously, in the printer for corrugated cardboard sheets, the control unit sets a timing for moving the ink supply roll toward or away from the printing cylinder by the roll moving unit, while taking into account a distance from a sheet feeding position in a corrugated cardboard sheet to a contact position with the printing plate, a distance on a surface of the printing plate from a position of the printing cylinder opposed to the ink supply roll to a position of the printing cylinder opposed to the corrugated cardboard sheet located on a downstream side in a rotation direction of the printing cylinder, a distance on a surface of the printing plate of a gap between ends of the printing plate, a conveying speed of a corrugated cardboard sheet, a rotation speed of the printing cylinder, and a moving time of the ink supply roll.

Advantageously, in the printer for corrugated cardboard sheets, when a distance from a sheet feeding position in a corrugated cardboard sheet to a contact position with the printing plate is denoted as R, a distance on a surface of the printing plate from a position of the printing cylinder opposed to the ink supply roll to a position of the printing cylinder opposed to the corrugated cardboard sheet on a downstream side in a rotation direction of the printing cylinder is denoted as N1, a distance on a surface of the printing plate of the printing cylinder is denoted as N, a distance on a surface of the printing plate is denoted as M, a conveying speed of a corrugated cardboard sheet and a rotation speed of the printing cylinder are denoted as V, and an approach moving timing of the ink supply roll is denoted as Td1*a*, a time T11 elapsed until the ink supply roll starts approaching the printing cylinder after a corrugated cardboard sheet starts from a sheet feeding position is set by $T11=\{R-N1-(N-M)/2\}/V-Td1a$.

Advantageously, in the printer for corrugated cardboard sheets, when a separation moving time of the ink supply roll is denoted as Td1*b*, a time T12 elapsed until the ink supply roll starts separating from the printing cylinder after a corrugated cardboard sheet starts from a sheet feeding position is set by $T12=\{R-N1+M+(N-M)/2\}/V-Td1b$.

Advantageously, in the printer for corrugated cardboard sheets, an air supply source, a pair of air cylinders provided on ends of a supporting shaft of the ink supply roll in its axial direction, a first air pipe from the air supply source to a branched portion, and a pair of second air pipes from the branched portion to the air cylinders are provided as the roll moving unit, and a diameter of the first air pipe is set larger than diameters of the second air pipes.

Advantageously, in the printer for corrugated cardboard sheets, fast exhaust valves are provided on connected portions between the second air pipes and the air cylinders.

Advantageously, in the printer for corrugated cardboard sheets, a servo-motor connected to a supporting shaft of the ink supply roll is provided as the roll moving unit.

According to another aspect of the present invention, a box making machine for corrugated cardboard sheets includes: a sheet feeding unit that feeds stacked corrugated cardboard sheets one by one; a printing device that performs printing on a surface of the corrugated cardboard sheet; a slotter/creaser that draws a creasing on a surface of the corrugated cardboard sheet along a corrugation of a corrugating medium and cuts a slot having a predetermined length along the creasing; a folding unit that folds the corrugated cardboard sheets to form corrugated cardboard boxes; and a counter ejector that stacks the corrugated cardboard boxes and discharges the corrugated cardboard boxes for a predetermined number. The printing device includes: a printing cylinder that is drivably and rotatably supported such that the printing cylinder is opposed to a conveyed corrugated cardboard sheet; a printing plate attached on a surface of the printing cylinder; an ink supply roll that is drivably and rotatably supported and supplies ink to the printing plate;

a roll moving unit that can move the ink supply roll toward or away from the printing cylinder; and a control unit that controls an operation of the roll moving unit such that the ink supply roll moves toward or away from the printing cylinder relative to an intermediate position of a gap between ends of the printing plate.

Effect of the Invention

According to the printer for corrugated cardboard sheets of the invention of claim 1, the printer includes the control unit that controls an operation of the roll moving unit such that the ink supply roll moves toward or away from the printing cylinder relative to an intermediate position of a gap between ends of the printing plate. Therefore, when the ink supply roll is moved toward or away from the intermediate position of the gap between the ends of the printing plate relative to the rotating printing cylinder, ink on the ink supply roll can be appropriately transferred on the printing plate, an ink film on the printing plate becomes uniform, and thus the printing precision can be enhanced.

According to the printer for corrugated cardboard sheets of the invention of claim 2, the timing for moving the ink supply roll toward or away from the printing cylinder by the roll moving unit is set in the control unit while taking into account the distance from the sheet feeding position in the corrugated cardboard sheet to the contact position with the printing plate, the distance from the position of the printing cylinder opposed to the ink supply roll to the position of the printing cylinder opposed to the corrugated cardboard sheet located on the downstream side in the rotation direction of the printing cylinder, the distance of the gap between the ends of the printing plate, the conveying speed of the corrugated cardboard sheet, the rotation speed of the printing cylinder, and the moving time of the ink supply roll. Therefore, it is possible to move the ink supply roll toward or away from the printing cylinder by the roll moving unit at an appropriate timing.

According to the printer for corrugated cardboard sheets of the invention of claim 3, the time elapsed until the ink supply roll starts approaching the printing cylinder after the corrugated cardboard sheet starts from the sheet feeding position is set using a predetermined equation. Accordingly, a timing at which the ink supply roll is brought close to the printing cylinder by the roll moving unit can be set with a simple configuration.

According to the printer for corrugated cardboard sheets of the invention of claim 4, the time elapsed until the ink supply roll starts separating from the printing cylinder after the corrugated cardboard sheet starts from the sheet feeding position is set using a predetermined equation. Therefore, a timing at which the ink supply roll is separated from the printing cylinder by the roll moving unit can be set with a simple configuration.

According to the printer for corrugated cardboard sheets of the invention of claim 5, the air supply source, the pair of air cylinders that moves the ink supply roll, the first air pipe from the air supply source to the branched portion, and the pair of second air pipes from the branched portion to the air cylinders are provided as the roll moving unit, and the diameter of the first air pipe is set larger than the diameters of the second air pipes. Therefore, a sufficient air amount can be secured even after the pipe branches off, an operation delay of the air cylinder can be suppressed, and the ink supply roll can be moved toward or away from the printing cylinder by the air cylinder at an appropriate timing.

According to the printer for corrugated cardboard sheets of the invention of claim 6, the fast exhaust valves are provided on connected portions between the second air pipes and the air cylinders. Therefore, air in the air cylinder can be discharged at an early stage by the fast exhaust valve, and an operation delay of the air cylinder can be suppressed with a simple configuration.

According to the printer for corrugated cardboard sheets of the invention of claim 7, the servo-motor connected to the supporting shaft of the ink supply roll is provided as the roll moving unit. Therefore, the ink supply roll can be moved toward or away from the printing cylinder at an appropriate timing by the servo-motor.

According to the box making machine for corrugated cardboard sheets of the invention of claim 8, the box making machine includes the sheet feeding unit, the printing device, the slotter/creaser, the folding unit, and the counter ejector, and the printing device includes the control unit that controls an operation of the roll moving unit such that the ink supply roll moves toward or away from the printing cylinder relative to an intermediate position of a gap between ends of the printing plate. Therefore, when the ink supply roll is moved toward or away from the intermediate position of the gap between the ends of the printing plate relative to the rotating printing cylinder, ink on the ink supply roll can be appropriately transferred on the printing plate, an ink film on the printing plate becomes uniform, and thus printing precision can be enhanced.

BRIEF DESCRIPTION OF DRAWINGS

FIG. 4-1 is a schematic diagram of an operation of a fast exhaust valve.

FIG. 4-2 is a schematic diagram of an operation of the fast exhaust valve.

EXPLANATIONS OF LETTERS OR NUMERALS

Figure 1:
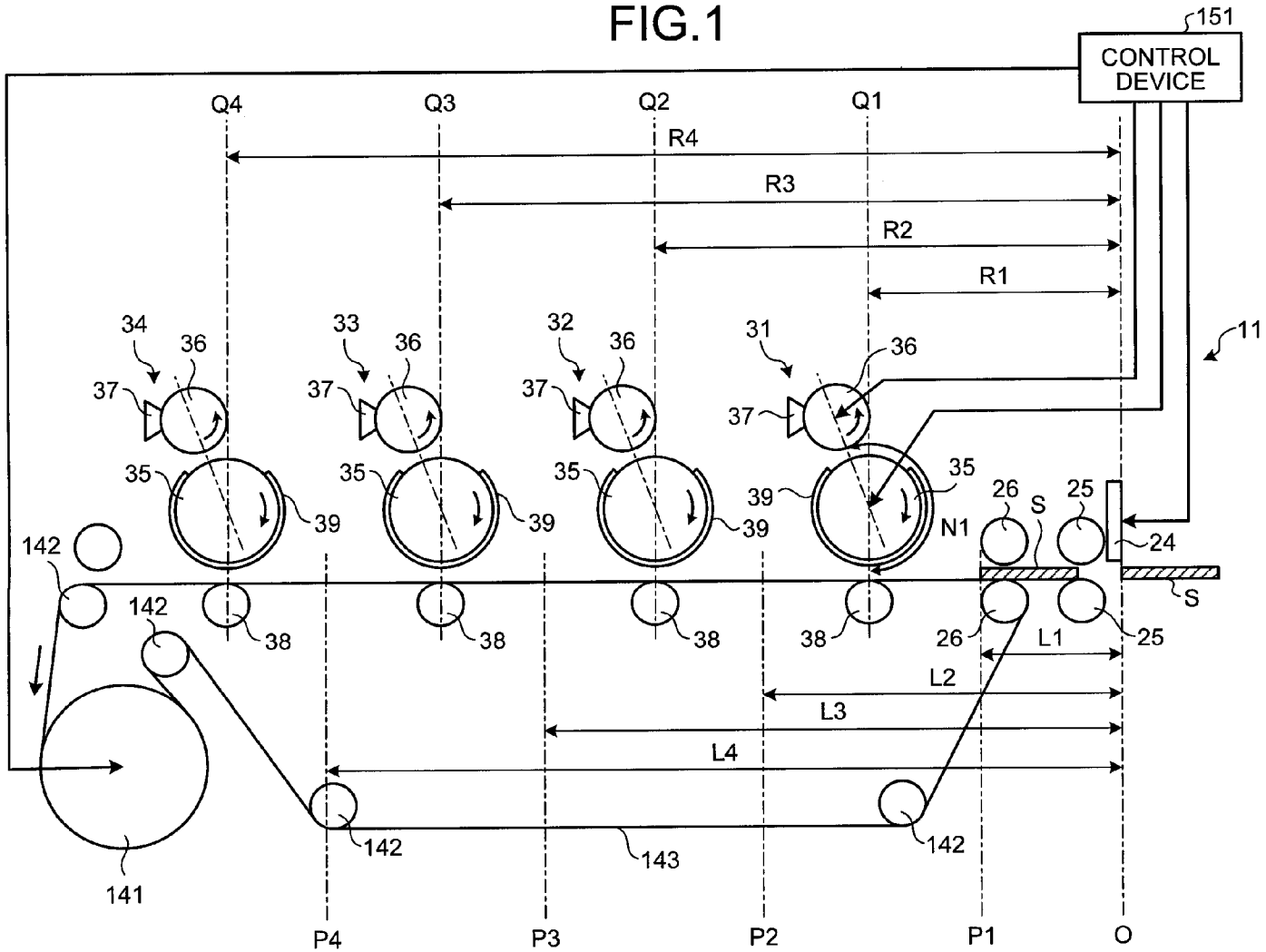
FIG. 1 is a schematic diagram of a printer for corrugated cardboard sheets according to a first embodiment of the present invention.

11 sheet feeding unit
12 printing device (printer)
13 slotter/creaser (printer for corrugated cardboard sheets)
14 folding unit
15 counter ejector
24 front stopper
31, 32, 33, 34 printing unit
35 printing cylinder
36 ink supply roll
38 receiving roll
39 printing plate
101 rotating lever
104, 104*a*, 104*b* air cylinder (roll moving unit)
113, 114 first air pipe
115*a*, 115*b*, 116*a*, 116*b* second air pipe
121*a*, 121*b*, 122*a*, 122*b* fast exhaust valve
141 driving roll
143 conveyer belt
151 control device
201 servo-motor (roll moving unit)
S corrugated cardboard sheet
B corrugated cardboard box

BEST MODE(S) FOR CARRYING OUT THE INVENTION

Exemplary embodiments of a printer for corrugated cardboard sheets and a box making machine for corrugated cardboard sheets according to the present invention will be explained below in detail with reference to the accompanying drawings. The present invention is not limited to the embodiments.

First Embodiment

Figure 2:
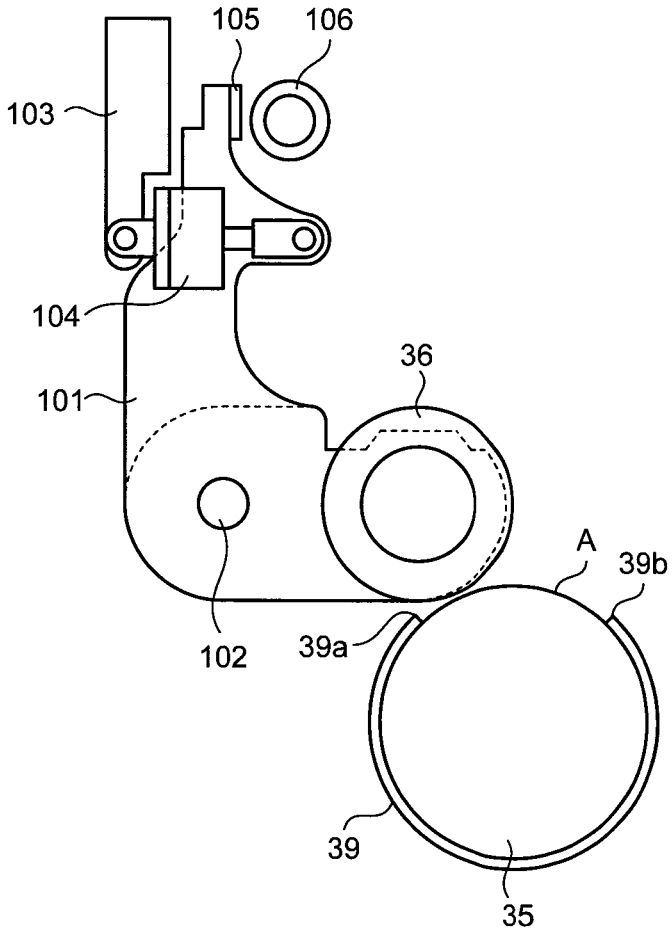
FIG. 2 is a schematic diagram of a configuration of an ink supply roll.
Figure 3:
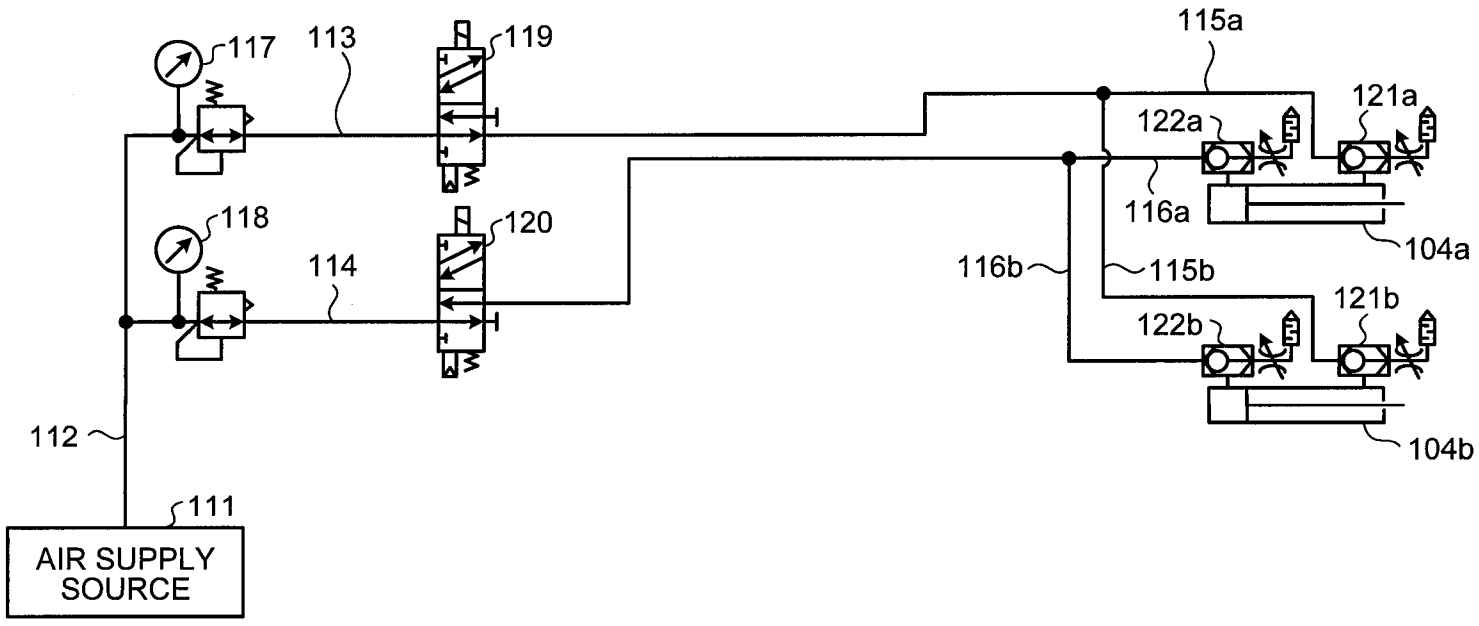
FIG. 3 is a schematic diagram of a piping configuration of an air cylinder in the ink supply roll.
Figures 1, 4:
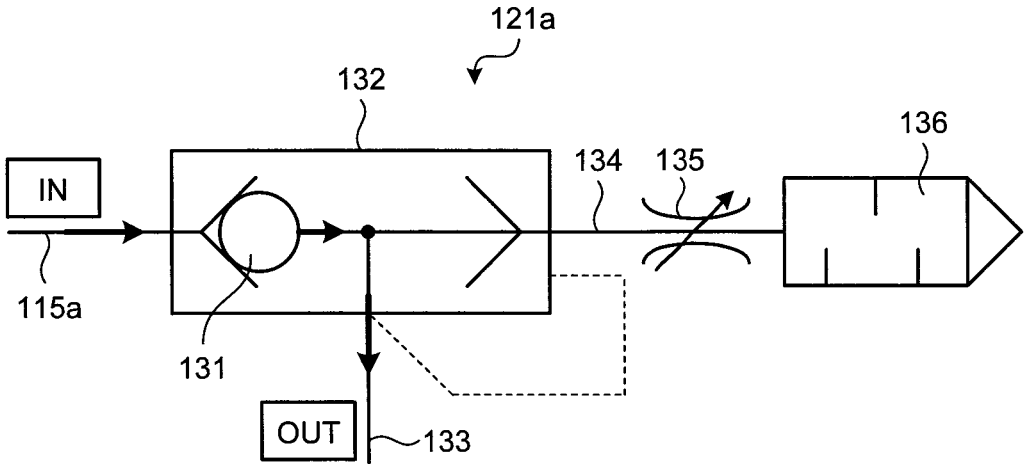
Figures 2, 4:
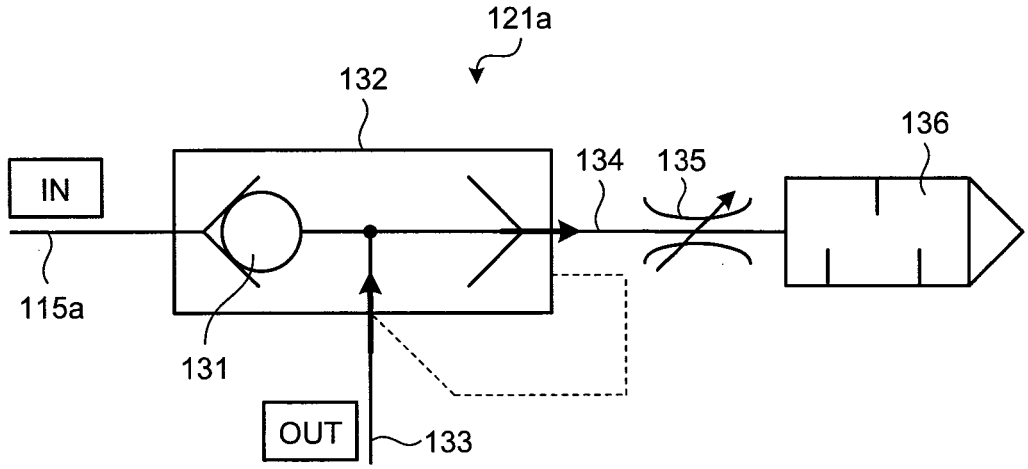
Figure 5:
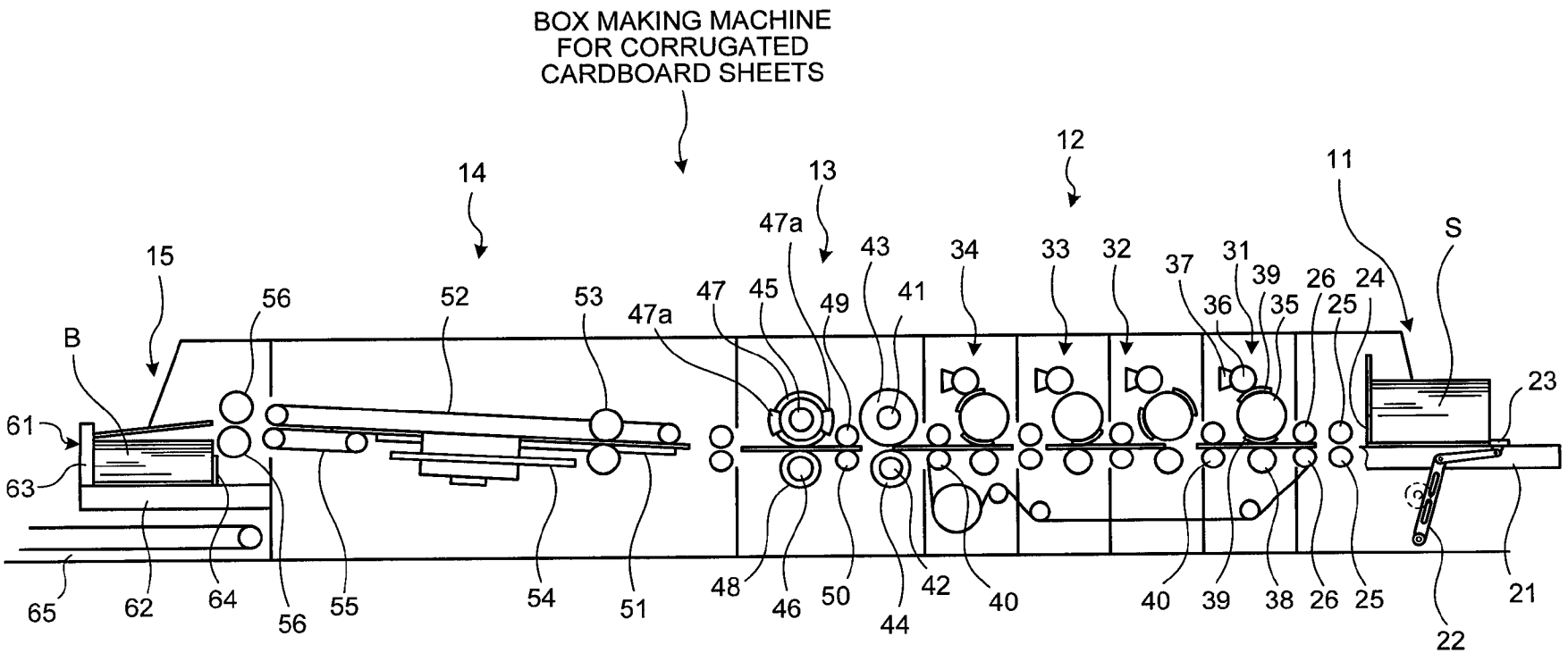
FIG. 5 is a schematic configuration diagram of a box making machine for corrugated cardboard sheets according to the first embodiment.

FIG. 1 is a schematic diagram of a printer for corrugated cardboard sheets according to a first embodiment of the present invention, FIG. 2 is a schematic diagram of a configuration of an ink supply roll, FIG. 3 is a schematic diagram of a piping configuration of an air cylinder in the ink supply roll, FIGS. 4-1 and 4-2 are schematic diagrams of an operation of a fast exhaust valve, and FIG. 5 is a schematic configuration diagram of a box making machine for corrugated cardboard sheets according to the first embodiment.

As shown in FIG. 5, the box making machine for corrugated cardboard sheets to which the printer for corrugated cardboard sheets according to the present embodiment is applied produces corrugated cardboard boxes B by processing a corrugated cardboard sheet S. The box making machine is constituted by a sheet feeding unit 11, a printing device (a printer) 12, a slotter/creaser 13, a folding unit 14, and a counter ejector 15. The corrugated cardboard sheet S is formed by adhering a corrugating medium between a bottom liner and a liner. The strength of the corrugated cardboard sheet S differs, according to intended usage, depending on a height and a pitch of corrugations of the corrugating medium, thicknesses and materials of the bottom liner, the liner, and the corrugating medium, the number of corrugating media sandwiched between the bottom liner and the liner and the like.

A large number of the corrugated cardboard sheets S are stacked on a table 21 by the sheet feeding unit 11, and a kicker 23 that reciprocates by a crank lever mechanism 22 can kick out the lowermost one of the corrugated cardboard sheets S one by one and feed it forward. The sheet feeding unit 11 includes a front stopper 24 that positions the corrugated cardboard sheet S at a sheet feeding position before feeding the corrugated cardboard sheet S. A pair of upper and lower feed rolls 25 and a pair of upper and lower feed rolls 26 are provided in front of the front stopper, and these rolls rotate at a constant speed. Therefore, when the kicker 23 is operated in a state that the corrugated cardboard sheet S is positioned at the sheet feeding position by the front stopper 24, the corrugated cardboard sheet S is kicked out and fed forward, sandwiched between the feed rolls 25 and 26 and conveyed, and thus it can be fed to the printing device 12.

The printing device 12 includes four printing units 31, 32, 33, and 34 to perform printing of four colors, and can perform printing using four ink colors (such as cyan, magenta, yellow, and black). The printing units 31, 32, 33, and 34 have substantially the same configurations, and each of them includes a printing cylinder 35, an ink supply roll 36, an ink chamber 37, and a receiving roll 38. A printing plate 39 is mounted on an outer periphery of the printing cylinder 35, the ink supply roll 36 that abuts against the printing plate 39 is provided near the printing cylinder 35, and the ink chamber 37 that stores ink is provided near the ink supply roll 36. The receiving roll 38 is opposed to a lower side of the printing cylinder 35. A pair of upper and lower transfer rolls 40 is provided at a downstream side of each of the printing cylinder 35 and each of the receiving roll 38.

Therefore, in the printing unit 31, ink is supplied on a surface of the ink supply roll 36 from the ink chamber 37, and when the printing cylinder 35 and the ink supply roll 36 rotate in synchronization with each other, ink on the ink supply roll 36 is transferred to the printing plate 39. When the corrugated cardboard sheet S is conveyed between the printing cylinder 35 and the receiving roll 38, printing is performed on the surface the corrugated cardboard sheet S in a state that the sheet is sandwiched between the printing plate 39 (the printing cylinder 35) and the receiving roll 38, and the corrugated cardboard sheet S is conveyed to the next printing unit 32 by the transfer rolls 40.

The slotter/creaser 13 draws a creasing on the corrugated cardboard sheet S and cuts a slot in the corrugated cardboard sheet S. In the slotter/creaser 13, an upper creasing head 43 and a lower creasing head (a creasing roll) 44 are fixed to a pair of upper and lower roll shafts 41 and 42, respectively, and the upper creasing head 43 and the lower creasing head 44 can rotate in synchronization with each other. An upper slotter head 47 and a lower slotter head 48 are fixed to a pair of upper and lower slotter shafts 45 and 46, and the upper slotter head 47 and the lower slotter head 48 can rotate in synchronization with each other. A pair of upper and lower conveying rolls 49 and 50 is provided between the creasing heads 43 and 44 and the slotter heads 47 and 48, and the conveying rolls 49 and 50 can rotate in synchronization with each other.

The upper creasing head 43 and the lower creasing head 44 draw a creasing on a surface of the corrugated cardboard sheet S conveyed therebetween (details thereof are described later). The upper slotter head 47 and the lower slotter head 48 cut slots in the corrugated cardboard sheet S conveyed therebetween, and two slotter knives 47*a* are fixed to an outer periphery of the upper slotter head 47. A plurality of (four sets in the present embodiment) the upper creasing heads 43 and the lower creasing heads 44, as well as the upper slotter heads 47 and the lower slotter heads 48 are provided in an axial direction.

The folding unit 14 applies an adhesive to a sticking tab piece while moving the corrugated cardboard sheet S, and then folds and adheres the corrugated cardboard sheet S, thereby producing the corrugated cardboard box B. In the folding unit 14, a guide rail 51 is arranged along a conveying direction of the corrugated cardboard sheet S, and a conveyer belt 52 is provided above the guide rail 51 such that the conveyer belt 52 can circulate. An adhering device 53, a folding bar 54, and a folding belt 55 are arranged along the guide rail 51 and the conveyer belt 52.

Therefore, the corrugated cardboard sheet S in which slots and sticking tab pieces are formed is supported by the guide rail 51 and the conveyer belt 52 and moved in the folding unit 14 and in this state, an adhesive is applied to the sticking tab piece by the adhering device 53, and then the sheet S is folded by the folding bar 54. When a folding operation proceeds to an angle of about 180 degrees, the folding belt 55 operates to increase a folding force, the sticking tab piece is firmly pressed by upper and lower feeding rolls 56, the adhered state is brought into a reliable state, and then the sheet S is fed.

The corrugated cardboard boxes B are made by adhering and folding the corrugated cardboard sheets S. The counter ejector 15 stacks the folded corrugated cardboard boxes B, sorts the boxes into a predetermined number of batches, and discharges these boxes, and the counter ejector 15 includes a hopper 61. The hopper 61 includes a vertically movable elevator 62, a front stopper plate 63, and an angle regulating plate 64. A transport conveyer 65 is arranged below the elevator 62.

Therefore, when the corrugated cardboard box B is fed by the upper and lower feeding rolls 56, a tip of the corrugated cardboard box B strikes the front stopper plate 63, the movement in a horizontal direction stops, the box B drops downward, and is stacked on the elevator 62, and a deviation thereof is corrected by the angle regulating plate 64. When a predetermined number of the corrugated cardboard boxes B are stacked on the hopper 61, the elevator 62 moves downward, a box batch (a predetermined number of the corrugated cardboard boxes B) on the elevator 62 is moved onto the transport conveyer 65, and the box batch is sent to a next process by the transport conveyer 65.

The printing device 12 of the box making machine for corrugated cardboard sheets is described in detail. As shown in FIG. 1, in the printing device 12, the first to fourth printing units 31, 32, 33, and 34 are provided in a conveying direction of corrugated cardboard sheets at a certain interval. As mentioned above, because the printing units 31, 32, 33, and 34 have substantially the same configurations, only the first printing unit 31 is explained. In the first printing unit 31, the printing cylinder 35 is located above a conveying line for the corrugated cardboard sheets S and drivably and rotatably supported, and the receiving roll 38 is located below the conveying line for the corrugated cardboard sheets S and opposed to the printing cylinder 35, and is rotatably supported. The printing plate 39 having a predetermined thickness is attached to the outer peripheral surface of the printing cylinder 35.

The ink supply roll 36 is located above the printing cylinder 35 and is drivably and rotatably supported. The ink supply roll 36 can supply ink stored in the ink chamber 37 to the printing plate 39 of the printing cylinder 35. In this case, the ink supply roll 36 is supported such that the ink supply roll 36 can move toward or away from the printing cylinder 35 (the printing plate 39). That is, as shown in FIG. 2, a rotating lever 101 formed in an L-shape and located above the printing cylinder 35 is turnably supported by a supporting shaft 102, and the ink supply roll 36 is rotatably supported by one end of the rotating lever 101. An air cylinder (a roll moving unit) 104 is provided between the other end of the rotating lever 101 and a supporting portion 103 that is integral with a frame (not shown).

Therefore, when the air cylinder 104 is in its contracted state, the ink supply roll 36 is in a position separated from a surface of the printing plate 39 in the printing cylinder 35. When the air cylinder 104 is extended from this state, the rotating lever 101 turns in a clockwise direction in FIG. 2, the ink supply roll 36 approaches the printing cylinder 35 and can move to a position where the ink supply roll 36 is in contact with the surface of the printing plate 39.

A stopper 105 is integrally formed on the other end of the rotating lever 101, and an eccentric roller 106 is provided on a frame that is opposed to the stopper 105. The eccentric roller 106 can be turned by an adjusting motor (not shown). Therefore, when the rotating lever 101 is turned by the air cylinder, the stopper 105 is abutted against the eccentric roller 106. With this configuration, a turning amount of the rotating lever, that is, a moving amount (a moving position) of the ink supply roll 36 can be defined. At this time, when the eccentric roller is turned by the adjusting motor, it is possible to adjust the turning amount of the rotating lever 101, and adjust the moving amount of the ink supply roll 36, that is, a contact state between the ink supply roll 36 and the printing plate 39.

An air supply system of the air cylinder 104 described above is explained here. As shown in FIG. 3, a pair of air cylinders 104*a* and 104*b* is provided on ends (an operation side and a driving side) of the support shaft of each of the ink supply rolls 36 in its axial direction, and operations of the air cylinders 104*a* and 104*b* are controlled in synchronization with each other. An air source pipe 112 is connected to an air supply source (such as a compressor) 111, the air source pipe 112 branches off into two pipes, and first air pipes 113 and 114 are provided. The first air pipe 113 branches off and two second air pipes 115*a* and 115*b* are provided, and the first air pipe 114 branches off and two second air pipes 116*a* and 116*b* are provided. The second air pipes 115*a* and 115*b* are connected to one cylinder chambers of the air cylinders 104*a* and

104*b*, and the second air pipes 116*a* and 116*b* are connected to the other cylinder chambers of the air cylinders 104*a* and 104*b*.

The first air pipes 113 and 114 include pressure gauges 117 and 118, respectively, and solenoid valves 119 and 120, respectively. Fast exhaust valves 121*a*, 122*a*, 121*b*, and 122*b* are provided on connected portions between the second air pipes 115*a*, 116*a*, 115*b*, and 116*b* and the air cylinders 104*a* and 104*b*. In the present embodiment, diameters of the first air pipes 113 and 114 are set larger than those of the second air pipes 115*a*, 116*a*, 115*b*, and 116*b*.

The fast exhaust valves 121*a*, 122*a*, 121*b*, and 122*b* have substantially the same configurations. That is, in the fast exhaust valve 121*a*, as shown in FIGS. 4-1, an end of the second air pipe 115*a* is connected to a pilot valve 132 having a check valve 131. The second air pipe 115*a* branches off from the pilot valve 132 into two pipes, that is, a first connecting pipe 133 and a second connecting pipe 134. The first connecting pipe 133 is connected to the air cylinder 104*a*, and the second connecting pipe 134 is opened into the atmosphere through a narrow portion 135 and a silencer 136. A pilot pressure of the first connecting pipe 133 is applied to the pilot valve 132.

Therefore, when air is supplied to the fast exhaust valve 121*a* from the second air pipe 115*a*, air is supplied to the pilot valve 132 through the check valve 131, and the air is supplied to the air cylinder 104*a* through the first connecting pipe 133. On the other hand, as shown in FIG. 4-2, when air is discharged from the air cylinder 104*a* into the first connecting pipe 133, discharge of air toward the second air pipe 115*a* is blocked by the check valve 131, air flows into the second connecting pipe 134, and is discharged into the atmosphere through the narrow portion 135 and the silencer 136.

Therefore, in the air supply system of the air cylinders 104 (104*a* and 104*b*) that operate the ink supply roll 36 having the configuration described above, as shown in FIGS. 2 and 3, when the solenoid valve 119 is opened and the solenoid valve 120 is closed, air from the air source pipe 112 is supplied to the one of the cylinder chambers of the air cylinders 104*a* and 104*b* through the air source pipe 112, the first air pipe 113 and the second air pipes 115*a* and 116*a*. With this configuration, the air cylinders 104*a* and 104*b* contract, and the ink supply roll 36 separates from a surface of the printing plate 39 in the printing cylinder 35. When the solenoid valve 119 is closed and the solenoid valve 120 is opened from this state, air from the air source pipe 112 is supplied to the other cylinder chambers of the air cylinders 104*a* and 104*b* through the air source pipe 112, the first air pipe 114, and the second air pipes 115*b* and 116*b*. With this configuration, the air cylinders 104*a* and 104*b* extend and the rotating lever 101 turns, and the ink supply roll 36 approaches the printing cylinder 35 and comes into contact with the surface of the printing plate 39. At this time, air in the one cylinder chambers of the air cylinders 104*a* and 104*b* is discharged at an early stage by the fast exhaust valves 121*a* and 121*b*.

Meanwhile, as shown in FIG. 1, a driving roll 141 can be rotated by a driving motor (not shown) below the conveying line of the corrugated cardboard sheets S and on a downstream side in the conveying direction. Further, an endless conveyer belt 143 is wound around the driving roll 141, plural guide rolls 142, the lower one of the feed rolls 25, and the receiving rolls 38. Therefore, the corrugated cardboard sheets S can be conveyed by the conveyer belt 143 at a predetermined constant speed.

The box making machine for corrugated cardboard sheets can be variously controlled by a control device 151. That is, the control device 151 can control a sheet-feeding start timing of the corrugated cardboard sheets S by controlling the kicker 23 and the front stopper 24 of the crank lever mechanism 22 in the sheet feeding unit 11. The control device 151 can control the conveying speed of corrugated cardboard sheets S by controlling the operation of each of driving motors (not shown) of the printing cylinder 35, the ink supply roll 36, and the driving roll 141. In this case, the speed is controlled such that a peripheral speed of the printing cylinder 35, a peripheral speed of the ink supply roll 36, and a speed of the conveyer belt 143 become equal to each other.

In the present embodiment, as shown in FIG. 1, the control device 151 controls the operation of the air cylinder 104 such that each of the ink supply rolls 36 moves toward or away from the printing cylinder 35 relative to an intermediate position of a gap between both ends of each of the printing plates 39. That is, as shown in FIG. 2, the printing plate 39 is wound around the outer peripheral surface of the printing cylinder 35 over a predetermined angle range, and a gap A having a predetermined length is provided between one end 39*a* and other end 39*b*. When the printing cylinder 35 rotates and an intermediate point of the gap A in its circumferential direction is opposed to the ink supply roll 36, the ink supply roll 36 is moved toward or away from the printing cylinder 35. Thus, the ink supply roll 36 appropriately comes into contact from the one end 39*a* to the other end 39*b* of the printing plate 39, and ink existing on a surface of the ink supply roll 36 can be uniformly transferred onto the surface of the printing plate 39.

In this case, the control device 151 sets a timing for moving the ink supply roll 36 toward or away from the printing cylinder 35 by the air cylinder 104 while taking account of the following factors, which are a distance between a sheet feeding position in the corrugated cardboard sheet S and a contact position with the printing plate 39, a distance on a surface of the printing plate 39 from a position of the printing cylinder 35 opposed to the ink supply roll 36 to a position on a downstream side of the printing cylinder 35 in its rotation direction opposed to the corrugated cardboard sheet S, a distance on a surface of the printing plate 39 of the gap between the ends of the printing plate 39, the conveying speed of the corrugated cardboard sheet S, the rotation speed of the printing cylinder 35, and the moving speed of the ink supply roll 36.

More specifically, as shown in FIG. 1, a sheet feeding position of a corrugated cardboard sheet defined by the front stopper 24 is denoted as 0, and contact positions between the corrugated cardboard sheet S and the printing plates 39 of the printing units 31, 32, 33, and 34 are denoted as Q1, Q2, Q3, and Q4, respectively. Further, distances from the sheet feeding position O of the corrugated cardboard sheet S to the contact positions Q1, Q2, Q3, and Q4 of the printing plates 39 of the printing units 31, 32, 33, and 34 are denoted as R1, R2, R3, and R4, respectively. A distance of the printing cylinder 35 on the surface of the printing plate 39, that is, a peripheral length of the printing cylinder 35 to which a thickness of the printing plate 39 is added is denoted as N. A distance on the surface of the printing plate 39, that is, a circumferential length of the printing plate 39 is denoted as M. A distance on the surface of the printing plate 39 from a position of the printing cylinder 35 opposed to the ink supply roll 36 to a position of the printing cylinder 35 opposed to the corrugated cardboard sheet S on a downstream side in the rotation direction of the printing cylinder 35 (the contact positions Q1, Q2, Q3, and Q4 with respect to the printing plates 39) is denoted as N1. A conveying speed of the corrugated cardboard sheet S by the conveyer belt 143 and a rotation speed of the printing cylinder 35 (a peripheral speed at the outer peripheral surface) are denoted as V. An approach moving time of the ink supply roll 36 by the air cylinder 104 is denoted as Td1*a*, and a separation moving time thereof is denoted as Td1*b*. The approach moving time Td1*a* and the separation moving time Td1*b* include a mechanical and electrical delay time.

When starting positions where the ink supply roll 36 is moved toward the intermediate point in the gap A are denoted as P1, P2, P3, and P4, distances from the sheet feeding position O of the corrugated cardboard sheet S to the moving starting position P1, P2, P3, and P4 of the ink supply roll 36 in the printing units 31, 32, 33, and 34 are denoted as L1, L2, L3, and L4.

The first printing unit 31 is described next. The distance L1 from the sheet feeding position O of the corrugated cardboard sheet S to the moving starting position P1 of the ink supply roll 36 in the first printing unit 31 is obtained by the following equation.

$$L1=R1-N1$$

In the gap A between the ends 39*a* and 39*b* of the printing plate 39 in the printing cylinder 35, a length Lc1 that is half of the length of the gap A in its circumferential direction is obtained by the following equation.

$$Lc1=(N-M)/2$$

A time T11 elapsed until the ink supply roll 36 starts approaching the printing cylinder 35 after the corrugated cardboard sheet S starts from the sheet feeding position O is obtained by the following equation.

$$T11=(L1-Lc1)/V-Td1a$$

There is a deviation Le (deviation time×speed) including control delay is included in the moving time of the ink supply roll 36. When the variation is large, a moving start timing of the ink supply roll 36 is advanced by the deviation amount. That is, when Lc1 is smaller than Le, Lc1 is set equal to Le.

A time T12 that is elapsed until the ink supply roll 36 starts separating from the printing cylinder 35 after the corrugated cardboard sheet S starts from the sheet feeding position O is obtained by the following equation.

$$T12=(L1+M+Lc1)/2/V1-Td1b$$

In the above explanations, when the thickness of the printing plate 39 is changed, a correction coefficient can be applied by deviating a distance in the circumferential direction, a distance in the radial direction and the moving time.

Calculation methods of the second, third and fourth printing units 32, 33, and 34 are the same except that the distances R2, R3, and R4 from the sheet feeding position O of the corrugated cardboard sheet S to the contact positions Q2, Q3, and Q4 with respect to the printing plates 39 of the printing units 32, 33, and 34 are replaced by the distances L2, L3, and L4 from the sheet feeding position O of the corrugated cardboard sheet S to the moving starting positions P2, P3, and P4 of the ink supply roll 36 in the printing units 32, 33, and 34.

Therefore, it is only necessary for the control device 151 to control the air cylinder 104 based on the time T11 elapsed until the ink supply roll 36 starts approaching the printing cylinder 35 after the corrugated cardboard sheet S starts from the sheet feeding position O, and based on the time T12 elapsed until the ink supply roll 36 starts separating from the printing cylinder 35 after the corrugated cardboard sheet S starts from the sheet feeding position O.

The printer for corrugated cardboard sheets according to the first embodiment includes the control device 151 that controls an operation of the air cylinder 104 such that the ink supply roll 36 is moved toward or away from the printing cylinder 35 relative to the intermediate position of the gap A between the ends 39*a* and 39*b* of the printing plate 39. Therefore, the ink supply roll 36 is moved toward or away from the intermediate position of the gap A between the ends 39*a* and 39*b* of the printing plate 39 relative to the rotating printing cylinder 35, ink on the ink supply roll 36 can be appropriately transferred to the printing plate 39, a uniform ink film is formed on the printing plate 39, and thus the printing precision can be enhanced.

In the printer for corrugated cardboard sheets according to the present embodiment, a timing for moving the ink supply roll 36 toward or away from the printing cylinder 35 by the air cylinder 104 is set while taking into account the distance from the sheet feeding position in the corrugated cardboard sheet S to the contact position with respect to the printing plate 39, the distance from the position of the printing cylinder 35 opposed to the ink supply roll 36 to a position of the printing cylinder 35 opposed to the corrugated cardboard sheet S located on the downstream side in the rotation direction of the printing cylinder 35, the distance of the gap between the ends of the printing plate 39, the conveying speed of the corrugated cardboard sheet S, the rotation speed of the printing cylinder 35, and the moving speed of the ink supply roll 36. Therefore, the timing for bringing the ink supply roll 36 close to the printing cylinder 35 by the air cylinder 104 can be set with a simple configuration. As a result, the ink supply roll 36 can be brought toward or away from the printing cylinder 35 at an appropriate timing.

In the printer for corrugated cardboard sheets according to the present embodiment, diameters of the first air pipes 113 and 114 from the air supply source 111 to the branched point are set larger than diameters of the pairs of second air pipes 115*a*, 115*b*, 116*a*, and 116*b* from the branched portion to the air cylinders 104*a* and 104*b*. Therefore, a sufficient air amount can be secured even after the pipe branches off, an operation delay of the air cylinders 104*a* and 104*b* can be suppressed, and the ink supply roll 36 can be moved toward or away from the printing cylinder 35 at an appropriate timing.

The fast exhaust valves 121*a*, 121*b*, 122*a*, and 122*b* are provided at connected portions of the second air pipes 115*a*, 115*b*, 116*a*, and 116*b* and the air cylinders 104*a* and 104*b*. Therefore, when air in the air cylinders 104*a* and 104*b* is discharged at an early stage by the fast exhaust valves 121*a*, 121*b*, 122*a*, and 122*b*, the operation delay of the air cylinders 104*a* and 104*b* can be suppressed with a simple configuration.

Second Embodiment

Figure 6:
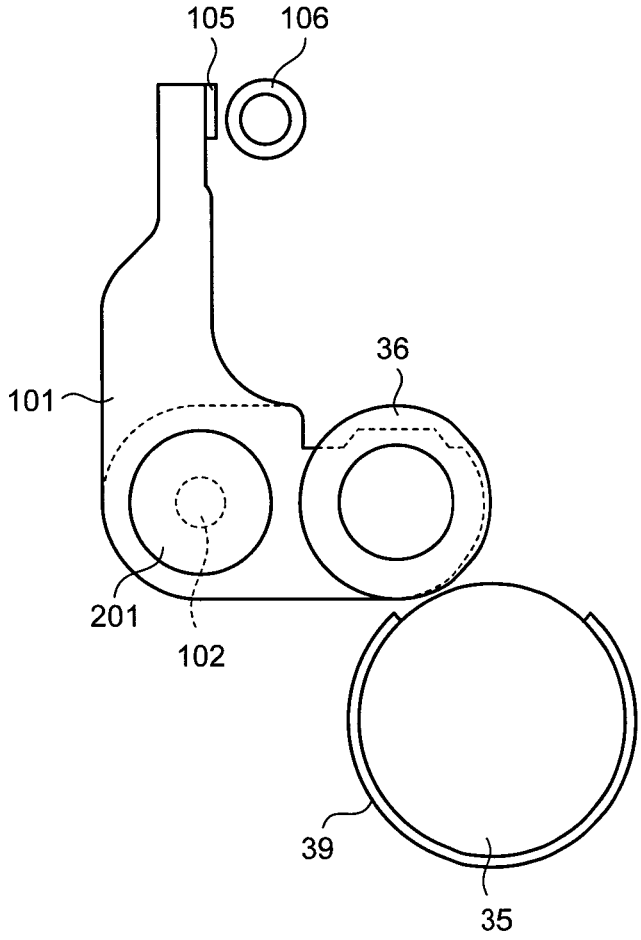
FIG. 6 is a schematic diagram of a configuration of an ink supply roll in a printer for corrugated cardboard sheets according to a second embodiment of the present invention.

FIG. 6 is a schematic diagram of a configuration of an ink supply roll in a printer for corrugated cardboard sheets according to a second embodiment of the present invention. Elements having functions identical to those explained in the above embodiment are denoted by like reference letters or numerals and redundant explanations thereof will be omitted.

In the ink supply roll in the printer for corrugated cardboard sheets according to the present embodiment, as shown in FIG. 6, the L-shaped rotating lever 101 is located above the printing cylinder 35 and turnably supported by the supporting shaft 102, and the ink supply roll 36 is rotatably supported by one end of the rotating lever 101. An output shaft of a servomotor (a roll moving unit) 201 is fixed to the supporting shaft 102 of the rotating lever 101.

Therefore, when the servo-motor 201 is rotated from a state that the ink supply roll 36 is at a position of the printing cylinder 35 separated away from a surface of the printing plate 39, the rotating lever 101 is turned in a clockwise direction in FIG. 6, the ink supply roll 36 approaches the printing cylinder 35, and the ink supply roll 36 can move to a position where the ink supply roll 36 is in contact with the printing plate 39.

In the printer for corrugated cardboard sheets according to the second embodiment, by moving the ink supply roll 36 by the servo-motor 201, the ink supply roll 36 can be moved toward or away from the printing cylinder 35 at an appropriate timing.

In the embodiments described above, the air cylinder 104 or the servo-motor 201 is applied as a roll moving unit; however, the application is not limited thereto.

INDUSTRIAL APPLICABILITY

The printer for corrugated cardboard sheets according to the present invention controls a timing for moving an ink supply roll toward or away from a printing cylinder to enhance printing precision, and can be applied to any type of box making machines for corrugated cardboard sheets.

The invention claimed is:

1. A printer for corrugated cardboard sheets, the printer comprising:

a printing cylinder that is drivably and rotatably supported such that the printing cylinder is opposed to a conveyed corrugated cardboard sheet;

a printing plate attached on a surface of the printing cylinder;

an ink supply roll that is drivably and rotatably supported and supplies ink to the printing plate;

a roll moving unit that moves the ink supply roll toward or away from the printing cylinder; and a control unit that controls an operation of the roll moving unit, wherein the control unit includes a timing setting unit that sets a timing for moving the ink supply roll, and a time obtaining unit that obtains a first time interval T11 based on a first equation and a second time interval T12 based on a second equation, the first time interval T11 being a time interval elapsed from (i) a time when the corrugated cardboard sheet starts from a sheet feeding position until (ii) a time when the ink supply roll starts approaching movement to the printing cylinder, and the second time interval T12 being a time interval elapsed from (a) the time when the corrugated cardboard sheet starts from the sheet feeding position until (b) a time when the ink supply roll starts separating movement from the printing cylinder, when the ink supply roll moves toward the printing cylinder relative to an intermediate position of a gap between ends of the printing plate, the timing setting unit sets the timing for moving the ink supply roll toward the printing cylinder based on the first time interval T11 obtained by the time obtaining unit, and when the ink supply roll moves away from the printing cylinder relative to the intermediate position of the gap between ends of the printing plate, the timing setting unit sets the timing for moving the ink supply roll away from the printing cylinder based on the second time interval T12 obtained by the time obtaining unit.

2. The printer according to claim 1, wherein when a distance from the sheet feeding position in the corrugated cardboard sheet to a contact position with the printing plate is denoted as R, a distance on a surface of the printing plate from a position of the printing cylinder opposed to the ink supply roll to a position of the printing cylinder opposed to the corrugated cardboard sheet on a downstream side in a rotation direction of the printing cylinder is denoted as N1, a distance of the printing cylinder on the surface of the printing plate is denoted as N, a distance on the surface of the printing plate is denoted as M, a conveying speed of the corrugated cardboard sheet and a rotation speed of the printing cylinder are denoted as V, and an approach moving timing of the ink supply roll is denoted as Td1*a*, the first equation defining the first time interval T11 is as follows:

$$T11=\{R-N1-(N-M)/2\}/V-Td1a.$$

3. The printer according to claim 2, wherein when a separation moving time of the ink supply roll is denoted as Td1*b*, the second equation defining the time interval T12 is as follows:

$$T12=\{R-N1+M+(N-M)/2\}/V-Td1b.$$

4. The printer according to claim 1, wherein the roll moving unit includes an air supply source, a pair of air cylinders respectively provided on ends of a supporting shaft of the ink supply roll in an axial direction of the supporting shaft, a first air pipe from the air supply source to a branched portion, and a pair of second air pipes from the branched portion to the air cylinders, and a diameter of the first air pipe is larger than diameters of the second air pipes.

5. The printer according to claim 4, wherein the roll moving unit further includes fast exhaust valves provided on connected portions between the second air pipes and the air cylinders.

6. The printer according to claim 1, wherein the roll moving unit further includes a servo-motor connected to a supporting shaft of the ink supply roll.

7. A box making machine for corrugated cardboard sheets, the box making machine comprising:

a sheet feeding unit that feeds stacked corrugated cardboard sheets one by one;

a printing device that performs a printing on a surface of each fed corrugated cardboard sheet;

a slotter/creaser that draws a creasing on the surface of each corrugated cardboard sheet along a corrugation of a corrugating medium, and cuts a slot having a predetermined length along the creasing;

a folding unit that folds the corrugated cardboard sheets to form corrugated cardboard boxes; and a counter ejector that stacks the corrugated cardboard boxes, and discharges the stacked corrugated cardboard boxes in a predetermined number, wherein the printing device includes:

a printing cylinder that is drivably and rotatably supported such that the printing cylinder is opposed to the corrugated cardboard sheet;

a printing plate attached on a surface of the printing cylinder;

an ink supply roll that is drivably and rotatably supported and supplies ink to the printing plate;

a roll moving unit that moves the ink supply roll toward or away from the printing cylinder; and a control unit that controls an operation of the roll moving unit, wherein the control unit includes a timing setting unit that sets a timing for moving the ink supply roll, and a time obtaining unit that obtains a first time interval T11 based on a first equation and a second time interval T12 based on a second equation, the first time interval T11 being a time interval elapsed from (i) a time when the corrugated cardboard sheet starts from a sheet feeding position until (ii) a time when the ink supply roll starts approaching movement to the printing cylinder, and the second time interval T12 being a time interval elapsed from (a) the time when the corrugated cardboard sheet starts from the sheet feeding position until (b) a time when the ink supply roll starts separating movement from the printing cylinder, when the ink supply roll moves toward the printing cylinder relative to an intermediate position of a gap between ends of the printing plate, the timing setting unit sets the timing for moving the ink supply roll toward the printing cylinder based on the first time interval T11 obtained by the time obtaining unit, and when the ink supply roll moves away from the printing cylinder relative to the intermediate position of the gap between ends of the printing plate, the timing setting unit sets the timing for moving the ink supply roll away from the printing cylinder based on the second time interval T12 obtained by the time obtaining unit.

8. The box making machine according to claim 7, wherein when a distance from the sheet feeding position in the corrugated cardboard sheet to a contact position with the printing plate is denoted as R, a distance on a surface of the printing plate from a position of the printing cylinder opposed to the ink supply roll to a position of the printing cylinder opposed to the corrugated cardboard sheet on a downstream side in a rotation direction of the printing cylinder is denoted as N1, a distance of the printing cylinder on the surface of the printing plate is denoted as N, a distance on the surface of the printing plate is denoted as M, a conveying speed of the corrugated cardboard sheet and a rotation speed of the printing cylinder are denoted as V, and an approach moving timing of the ink supply roll is denoted as Td1*a*, the first equation defining the first time interval T11 is as follows:

$$T11=\{R-N1-(N-M)/2\}/V-Td1a.$$

9. The box making machine according to claim 8, wherein when a separation moving time of the ink supply roll is denoted as Td1*b*, the second equation defining the second time interval T12 is as follows:

$$T12=\{R-N1+M+(N-M)/2\}/V-Td1b.$$

10. The box making machine according to claim 7, wherein the roll moving unit includes an air supply source, a pair of air cylinders provided on ends of a supporting shaft of the ink supply roll in its axial direction, a first air pipe from the air supply source to a branched portion, and a pair of second air pipes from the branched portion to the air cylinders, and a diameter of the first air pipe is larger than diameters of the second air pipes.

11. The box making machine according to claim 10, wherein the roll moving unit further includes fast exhaust valves provided on connected portions between the second air pipes and the air cylinders.

12. The box making machine according to claim 7, wherein the roll moving unit further includes a servo-motor connected to a supporting shaft of the ink supply roll.

* * * * *